US006656060B2

(12) United States Patent
Masutani et al.

(10) Patent No.: US 6,656,060 B2
(45) Date of Patent: Dec. 2, 2003

(54) GOLF BALL

(75) Inventors: Yutaka Masutani, Chichibu (JP); Junji Hayashi, Chichibu (JP); Hisashi Yamagishi, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/929,065

(22) Filed: Aug. 15, 2001

(65) Prior Publication Data

US 2003/0045377 A1 Mar. 6, 2003

(30) Foreign Application Priority Data

Jun. 21, 2001 (JP) ..... 2001-188596

(51) Int. Cl.[7] ..... A63B 37/04; A63B 37/06; A63B 37/00

(52) U.S. Cl. ..... 473/377; 473/371; 473/351

(58) Field of Search ..... 473/351–377

(56) References Cited

U.S. PATENT DOCUMENTS

| | | | | | |
|---|---|---|---|---|---|
| 5,403,010 | A | | 4/1995 | Yabuki et al. | |
| 5,497,996 | A | * | 3/1996 | Cadorniga | 473/365 |
| 5,645,496 | A | | 7/1997 | Endo et al. | |
| 5,752,889 | A | * | 5/1998 | Yamagishi et al. | 273/DIG. 20 |
| 5,779,563 | A | * | 7/1998 | Yamagishi et al. | 473/371 |
| 5,803,834 | A | | 9/1998 | Yamagishi et al. | |
| 5,807,192 | A | * | 9/1998 | Yamagishi et al. | 273/DIG. 20 |
| 5,846,142 | A | * | 12/1998 | Kakiuchi et al. | 473/351 |
| 6,126,558 | A | * | 10/2000 | Higuchi et al. | 473/374 |
| 6,520,872 | B2 | * | 2/2003 | Endo et al. | 473/374 |

FOREIGN PATENT DOCUMENTS

| | | |
|---|---|---|
| JP | 6-154357 | 6/1994 |
| JP | 7-194732 | 8/1995 |
| JP | 9-239067 | 9/1997 |
| JP | 2000-5341 | 1/2000 |
| JP | 2001-79117 | 3/2001 |

* cited by examiner

*Primary Examiner*—Paul T. Sewell
*Assistant Examiner*—Alvin A. Hunter, Jr.
(74) *Attorney, Agent, or Firm*—Sughrue Mion, PLLC

(57) ABSTRACT

A golf ball includes a solid core and a cover of at least one layer; wherein each of a specific gravity of the solid core and a specific gravity of the cover is nearly equal to a value (S) of a relation expression given by $S=W/[(\pi/6)\times D^3]$, where W is a weight of the golf ball and D is a diameter of the golf ball. The golf ball can enhance the durability to increase the carry of the ball with less variations in carry of the ball.

4 Claims, 1 Drawing Sheet

GOLF BALL

BACKGROUND OF THE INVENTION

The present invention relates to a golf ball capable of enhancing the durability to increase the carry of the ball with less variation in carry of the ball.

Golf balls have been required to be improved in terms of player's soft feeling of hitting and carrying performance; however, it has been regarded as difficult to make these properties compatible with each other for the following reasons:

(1) If a solid core is softened for ensuring the player's soft feeling, a deformed amount of the hit ball becomes large, to degrade the durability against cracking.

(2) If both the solid core and a cover are softened for ensuring both the player's soft feeling and durability against cracking, the resilience and initial velocity of the ball are reduced, to sacrifice the carrying performance.

(3) Depending on a difference between the geometric position of the center of gravity of each golf ball and the actual position of the center of gravity of the ball, which difference is possibly caused at the time of production of the ball, there occur large variations in carry among the golf balls.

To solve the above problems, Japanese Patent Laid-open No. 2000-5341 has proposed an excellent golf ball characterized by combining a solid core, which is softened to improve player's soft feeling and durability against cracking, with a cover to which a reinforcement filler is added.

For such a golf ball, it has been also required to increase the carry of the ball while keeping high durability, and to suppress variations in carry among golf balls of the same kind.

SUMMARY OF THE INVENTION

An object of the present invention is to provide a golf ball capable of enhancing the durability to increase the carry of the ball with less variations in carry of the ball.

To achieve the above object, the present inventor has earnestly examined and found that at the time of hitting a golf ball, the center of gravity of the ball is shift by deformation of the ball caused by hitting the ball, and that with respect to the relationship between the solid core and the cover of the golf ball disclosed in Japanese Patent Laid-open No. 2000-5341, if the specific gravity of the cover is larger than the specific gravity of the solid core, the shift of the center of gravity of the ball due to deformation of the ball caused until the initial stage of flying since immediately after hitting is liable to become large, and particularly, if the solid core becomes softer, since the shift of the center of gravity of the ball becomes larger, the carrying performance may be degraded.

To cope with such an inconvenience, the present inventor has further examined, and eventually found that a golf ball including a solid core and a cover of at least one layer; wherein each of a specific gravity of the solid core and a specific gravity of the cover is nearly equal to a value (S) of a relation expression given by $S=W/[(\pi/6)\times D^3]$, where W is a weight of the golf ball and D is a diameter of the golf ball, is advantageous in that since the specific gravity of the entire ball is equalized, the spin performance is stabilized, and the continuation of flying of the ball becomes very high without runout of the ball, it is possible to enhance the carrying performance, reduce the possibility of drop of the ball, improve the durability, reduce variations in carry among golf balls of the same kind, and increase the carry of the ball. The present invention has been accomplished on the basis of the above knowledge.

According to the present invention, there is provided a golf ball including a solid core and a cover of at least one layer; wherein each of a specific gravity of the solid core and a specific gravity of the cover is nearly equal to a value (S) of a relation expression given by $S=W/[(\pi/6)\times D^3]$, where W is a weight of the golf ball and D is a diameter of the golf ball.

A surface hardness of the solid core is preferably higher than a center hardness of the solid core by 8 to 20 in JIS-C hardness.

A surface hardness of the golf ball is preferably higher than a center hardness of the solid core by 20 to 45 in JIS-C hardness.

A surface hardness of the golf ball is preferably higher than a surface hardness of the solid core by 10 to 30 in JIS-C hardness.

A flexural amount of the golf ball, measured by applying a load of 98 to 1274N thereto, is preferably in a range of 3.5 to 6.0 mm.

A diameter (D) of the golf ball is preferably in a range of 42.60 to 42.78 mm.

A weight (W) of the golf ball is preferably in a range of 45.1 to 45.9 g.

The golf ball is preferably a two-piece solid golf ball including a solid core and a cover of one layer.

A ratio of a specific gravity of the solid core to a specific gravity of the cover (specific gravity of solid core/specific gravity of cover) is preferably in a range of 0.910 to 1.095.

DETAILED DESCRIPTION OF THE PREFERRED EMBODIMENTS

Figure 1:
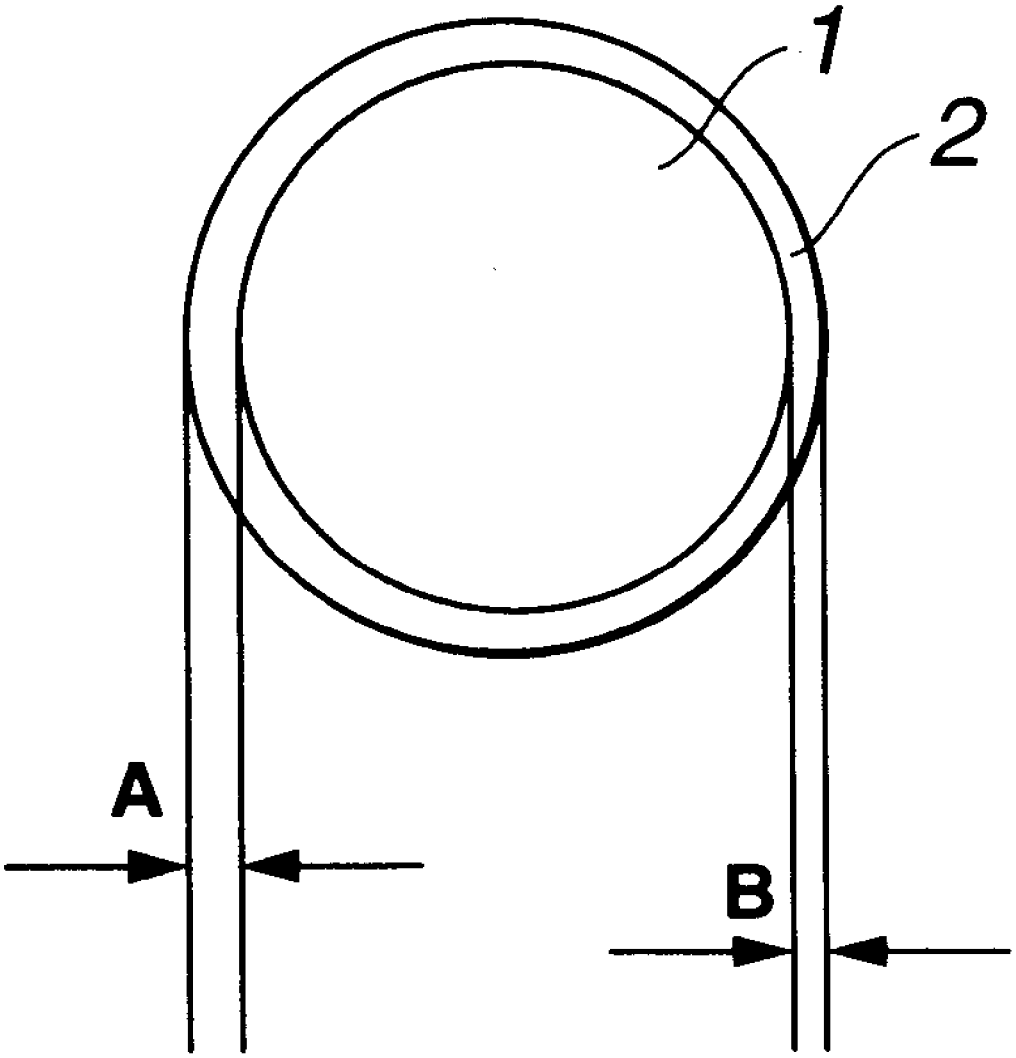
FIG. 1 is a schematic view showing a configuration of a golf ball used for Experimental Example of the present invention.

The present invention will be hereinafter described in more detail. A golf ball of the present invention, which includes a solid core and a cover, is characterized in that the specific gravity of each layer is equalized and the balance between the specific gravities of the entire ball is optimized to be described later. Such a golf ball can be produced from known materials.

The solid core may be made from a rubber composition containing polybutadiene, preferably, cis-1,4-polybutadiene as a main rubber component.

In addition to polybutadiene, another diene based rubber, such as styrene-butadiene rubber (SBR), natural rubber, isoprene rubber, or ethylene-propylene-diene rubber (EPDM) may be suitably mixed in the above base rubber.

In addition to the above main rubber component, unsaturated carboxylic acid and/or a metal salt thereof, an organic peroxide, an organic sulfur compound, and the like can be added to the rubber composition for producing the solid core.

Examples of the unsaturated carboxylic acids may include acrylic acid, metacrylic acid, maleic acid, fumaric acid. In particular, acrylic acid and metacrylic acid are preferably used.

Examples of the metal salts of unsaturated carboxylic acids may include zinc salts and magnesium salts of unsaturated aliphatic acids, for example, zinc metacrylate and zinc acrylate. In particular, zinc acrylate is preferably used.

The content of the unsaturated carboxylic acid and/or metal salt thereof may be set, on the basis of 100 parts by mass of the main rubber component, in a range of 10 parts by mass or more, preferably, 15 parts by mass or more, more preferably, 20 parts by mass or more, with the upper limit being in a range of 50 parts by mass or less, preferably, 45 parts by mass or less, more preferably, 40 parts by mass or less, most preferably, 35 parts by mass or less. If the content is excessively small, the resilience is reduced, and if excessively large, the solid core becomes excessively hard, which may sometimes make player's feeling of hitting of the golf ball undesirable.

As the organic peroxide, there can be used a commercial product such as "Percumyl D" (sold by NOF CORPORATION), "Perhexa 3M" (sold by NOF CORPORATION), "Luperco 231XL" (sold by Elf Atochem Japan). Two kinds or more organic peroxides may be used in combination as needed.

The content of the organic peroxide may be set, on the basis of 100 parts by mass of the main rubber component, in a range of 0.1 part by mass or more, preferably, 0.3 part by mass or more, more preferably, 0.5 part by mass or more, with the upper limit being in a range of 5 parts by mass or less, preferably, 4 parts by mass or less, more preferably, 3 parts by mass or less, most preferably, 2 parts by mass or less. If the content is excessively large or small, the resilience, player's feeling of hitting the golf ball, and durability against cracking may be reduced.

To adjust the specific gravity, an inorganic filler can be added to the rubber composition of the present invention. Examples of the inorganic fillers may include zinc oxide, barium sulfate, and calcium carbonate. In order to obtain a suitable weight and desirable resilience, the content of the inorganic filler may be set, on the basis of 100 parts by mass of the main rubber component, in a range of 1 part by mass or more, preferably, 3 parts by mass or more, more preferably, 5 parts by mass or more, most preferably, 7 parts by mass or more, with the upper limit being in a range of 130 parts by mass or less, preferably, 50 parts by mass or less, more preferably, 45 parts by mass or less, most preferably, 40 parts by mass or less.

An antioxidant may be further added to the rubber composition. As the antioxidant, there can be used a commercial product such as "NOCRAC NS-6, NS-30" (sold by Ouchi-Sinko Chemical Industrial Co., Ltd.), or "Yoshinox 425" (Yoshitomi Pharmaceutical Co., Ltd.). In order to obtain desirable resilience and durability, the content of the antioxidant may be set, on the basis of 100 parts by mass of the main rubber component, in a range of 0 part by mass or more, preferably, 0.05 part by mass or more, more preferably, 0.1 part by mass or more, most preferably, 0.2 part by mass or more, with the upper limit being in a range of 3 parts by mass or less, preferably, 2 parts by mass or less, more preferably, 1 part by mass or less, most preferably, 0.5 part by mass or less.

An organic sulfur compound can be added to the rubber composition of the present invention. Examples of the organic sulfur compounds may include thiophenol, thionaphthol, halogenated thiophenol, or metal salts thereof, more concretely, zinc salts of pentachlorothiophenol, pentafluorothiophenol, pentabromothiophenol, and parachlorothiophenol; and diphenyl polysulfide, dibenzil polysulfide, dibenzoil polysulfide, dibenzothiazoil polysulfide, and dithiobenzoil polysulfide, each of which has the sulfur number of 2 to 4. In particular, a zinc salt of pentachlorothiophenol or diphenyl disulfide is preferably used.

The content of the organic sulfur compound may be set, on the basis of 100 parts by mass of the main rubber component, in a range of 0.05 part by mass or more, preferably, 0.1 part by mass or more, more preferably, 0.2 part by mass or more, with the upper limit being in a range of 5 parts by mass or less, preferably, 4 parts by mass or less, more preferably, 3 parts by mass or less, most preferably, 2.5 parts by mass or less.

The solid core of the present invention can be formed by vulcanizing and hardening the above-described rubber composition by a known process. For example, a vulcanizing temperature may be set in a range of 100 to 200° C., and a vulcanizing time be set in a range of 10 to 40 min.

The specific gravity of the solid core of the present invention is required to be nearly equal to a value (S) of a relation expression given by $$S=W/[(\pi/6)\times D^3]$$

where W is a weight of the golf ball and D is a diameter of the golf ball. The wording "the specific gravity of the solid core is required to be nearly equal to a value (S)" means that the ratio of the specific gravity of the solid core to the (S) value (specific gravity of solid core/(S) value) is generally in a range of 0.910 or more, preferably, 0.950 or more, more preferably, 0.980 or more, with the upper limit being in a range of 1.095 or less, preferably, 1.075 or less, more preferably, 1.055 or less.

According to the present invention, the specific gravity of the solid core is not particularly limited insofar as it satisfies the above range, but may be set in a range of 1.000 or more, preferably, 1.050 or more, with the upper limit being in a range of 1.300 or less, preferably, 1.250 or less, more preferably, 1.200 or less.

With respect to the hardness of the solid core of the present invention, the surface hardness (JIS-C hardness) may be higher than the center hardness (JIS-C hardness). In this case, the difference between the surface hardness and the center hardness may be set in a range of 8 or more, preferably, 9 or more, more preferably, 10 or more, with the upper limit being in a range of 20 or less, preferably, 18 or less, more preferably, 16 or less. If the hardness difference is excessively small, since the center hardness to the entire hardness of the ball is excessively high, there occurs local deformation of the ball at the time of hitting the center of the ball, tending to degrade the durability against cracking. If excessively large, since the hitting energy is diffused to the entire ball, the resilience becomes insufficient, tending to lower the initial velocity of the hit ball.

The hardness distribution of the golf ball of the present invention may be set such that the center hardness is gradually increased toward the surface of the solid core. This is advantageous in that since local deformation of the ball at the time of hitting the ball less occurs and thereby the impact given to the ball can be diffused to the entire ball in good balance, it is possible to lower the spin of the ball, to increase the carrying angle of the ball, and to enhance the resilience.

According to the present invention, the deformed amount of the solid core, measured by applying a load of 98 N (10 kg) to 1274 N (130 kg) thereto, may be adjusted in a range of 3.5 mm or more, preferably, 4.0 mm or more, more preferably, 4.3 mm or more, with the upper limit being in a range of 7.0 mm or less, preferably, 6.0 mm or less, more preferably, 5.0 mm or less. If the flexural amount, that is, the deformed amount of the ball is excessively small, player's feeling of hitting the ball is degraded, and particularly, the spin of the ball becomes excessively high at the time of long-shot with a driver when the ball is liable to be largely deformed, to reduce the carry of the ball. If excessively large, player's feeling of hitting the ball becomes dull, the carry of the ball is reduced because of insufficient resilience, and durability against cracking due to repeated hitting is degraded.

The diameter of the solid core of the present invention may be set in a range of 38.0 mm or more, preferably, 38.5 mm or more, more preferably, 38.7 mm or more, most preferably, 38.9 mm or more, with the upper limit being in a range of 41.0 mm or less, preferably, 40.7 mm or less, more preferably, 40.3 mm or less, most preferably, 40.1 mm or less.

The golf ball of the present invention is a solid golf ball including the above-described solid core and a cover. Such a solid golf ball may be any one of a two-piece type including one cover layer and a multi-piece type including two or more cover layers. According to the present invention, particularly, from the viewpoint of effectively achieving the effect of improving a golf ball, the golf ball may be of a two-piece solid golf ball.

The cover of the golf ball of the present invention is made from a cover material mainly containing an ionomer resin. As the ionomer resin, there can be used a commercial product, for example, "Surlyn 6320, 8120, or 7930" (Du Pont DE NEMOURS & COMPANY, USA), or "Himilan 1706, 1605, 1855, 1601, or 1557" (Du Pont-Mitsui Polychemicals Co., Ltd.).

In addition to the above ionomer resin, an inorganic filler can be added to the cover material of the present invention. The specific gravity of the inorganic filler may be set in a range of 3.5 or more, preferably, 4 or more. As the inorganic filler, there is preferably used a white inorganic filler.

Examples of the inorganic fillers may include barium sulfate and titanium dioxide. In particular, barium sulfate is preferably used.

More preferably, barium sulfate is used in combination with titanium dioxide. By optimizing the mixing ratio of barium sulfate and titanium dioxide, it is possible to improve the durability and to give the ball a desirable appearance not tinged with yellow. The mixing ratio of barium sulfate and titanium dioxide may be set such that the content of barium sulfate is larger than that of titanium dioxide. Concretely, the mixing ratio in mass (barium sulfate: titanium dioxide) may be set in a range of 12:1 to 6:5, preferably, 6:1 to 6:3. If only barium sulfate is added, the ball is tinged with yellow to degrade the appearance of the ball, and if only titanium dioxide is added, the durability may be degraded.

The content of the inorganic filler (particularly, the total amount of barium sulfate and titanium dioxide) is not particularly limited but may be set, on the basis of 100 parts by mass of the ionomer resin, in a range of 10 parts by mass or more, preferably, 15 parts by mass or more, more preferably, 18 parts by mass or more, with the upper limit being in a range of 30 parts by mass or less, preferably, 25 parts by mass or less, more preferably, 22 parts by mass or less. If the content is excessively small, the durability may be degraded, and if excessively large, the resilience may be reduced. In addition, if the inorganic filler contains two or more components, barium sulfate may be selected as the main component of the inorganic filler.

Further, known cover components such as zinc oxide, magnesium stearate, and a pigment can be added to the cover material, as needed.

The cover of the golf ball of the present invention can be formed by a known process of putting the solid core in a specific mold for injection molding, and injection-molding the cover material. Alternatively, the cover can be formed by preparing a pair of cup-halves made from the cover material, putting the solid core covered with the cup-halves in a specific mold, and press-molding the resultant solid core covered with the cup-halves.

In spite of the number of the layers forming the cover, the specific gravity of the cover of the present invention is required to be nearly equal to a value (S) of a relation expression given by $$S\ W/[(\pi/6)\times D^3]$$

where W is a weight of the golf ball and D is a diameter of the golf ball. The wording "the specific gravity of the cover is required to be nearly equal to a value (S)" means that the ratio of the specific gravity of the cover to the (S) value (specific gravity of cover/(S) value) is generally in a range of 0.910 or more, preferably, 0.930 or more, more preferably, 0.950 or more, with the upper limit being in a range of 1.095 or less, preferably, 1.075 or less, more preferably, 1.055 or less.

According to the present invention, the specific gravity of the cover of the present invention is not particularly limited insofar as it satisfies the above range but may be set in a range of 1.000 or more, preferably, 1.050 or more, with the upper limit being in a range of 1.300 or less, preferably, 1.250 or less, more preferably, 1.200 or less.

With respect to the golf ball of the present invention, the ratio of the specific gravity of the solid core to the specific gravity of the cover (specific gravity of solid core/specific gravity of cover) may be set in a range of 0.910 or more, preferably, 0.950 or more, more preferably, 0.990 or more, with the upper limit being in a range of 1.095 or less, preferably, 1.075 or less, more preferably, 1.060 or less, most preferably, 1.050 or less. With such adjustment of the specific gravity, even if the core of the golf ball is off-centered, it is possible to prevent the weight balance of the ball from being degraded, and hence to enhance the accuracy of the ball at a low cost.

The Shore D hardness of the cover of the golf ball of the present invention may be set in a range of 55 or more, preferably, 56 or more, more preferably, 57 or more, with the upper limit being in a range of 65 or less, preferably, 64 or less. If the hardness is higher than the above range, the durability against cracking is degraded, and if lower than the above range, the resilience becomes insufficient, and thereby it may often fail to obtain a desired initial velocity of the ball.

In spite of the type of the golf ball, that is, a two-piece solid golf ball or a multi-piece solid golf ball (in this case, the thickness of a cover is the total thickness of cover layers), the thickness of the cover may be set in a range of 0.7 mm or more, preferably, 1.0 mm or more, with the upper limit being in a range of 2.3 mm or less, preferably, 2.0 mm or less. If the cover is excessively thick, player's feeling of hitting the ball may be degraded. It is to be noted that the thickness of the cover in this embodiment is obtained by measuring the thickness of a portion (land portion), at which dimples are not formed, of the cover.

In the case of strictly comparing the thicknesses of various measurement points of the cover of the same golf ball with each other, there may occur differences in thickness between the measurement points. According to the present invention, the thickness of the cover may be further adjusted such that the differences in thickness between the measurement points become as small as possible. To be more specific, for the purpose of eliminating the off-center of the ball and optimizing the weight balance of the ball, a difference in thickness between the thickest point and the thinnest point of the cover may be set in a range of less than 0.4 mm, preferably, 0.3 mm or less.

The hardness (expressed in deformed amount) of the golf ball of the present invention, measured by applying a load of 98 N (10 kg) to 1274 N (130 kg) thereto, may be in a range of 3.5 mm or more, preferably, 3.7 mm or more, with the upper limit being in a range of 6.0 mm or less, preferably, 5.5 mm or less, more preferably, 4.5 mm or less. If the flexural amount, that is, the deformed amount of the ball is excessively small, player's feeling of hitting the ball is degraded, and particularly, the spin of the ball becomes excessively high at the time of long-shot with a driver when the ball is liable to be largely deformed, to reduce the carry of the ball. If excessively large, player's feeling of hitting the ball becomes dull, the carry of the ball is reduced because of insufficient resilience, and durability against cracking due to repeated hitting may be degraded.

The surface hardness of the golf ball of the present invention is preferably higher than the center hardness of the solid core. Concretely, the hardness difference (JIS-C hardness) may be set in a range of 20 or more, preferably, 25 or more, more preferably, 30 or more, with the upper limit being in a range of 45 or less, preferably, 40 or less. If the hardness difference is excessively small, when the ball is hit at a low head speed at which the deformation of the cover contributes to the resilience and the initial velocity, it fails to obtain sufficient resilience and to obtain a desirable initial velocity. If excessively large, a deformation stress applied to the cover is increased, so that the durability against cracking may be degraded. In this case, the golf ball may have a hardness distribution in which the hardness is gradually increased from the center to the surface of the ball. This is advantageous in that since the deformation of the hit ball is not locally but wholly diffused to the ball, it is possible to lower the spin of the ball, to increase the carrying angle of the ball, and to enhance the resilience.

The surface hardness of the golf ball of the present invention is preferably higher than the surface hardness of the solid core. The hardness difference (JIS-C hardness) may be set in a range of 10 or more, preferably, 16 or more, more preferably, 20 or more, with the upper limit being in a range of 30 or less, preferably, 25 or less. If the hardness difference is excessively small, when the ball is hit at a low head speed, the resilience may become insufficient to lower the initial velocity of the ball. If excessively large, the durability against cracking may be degraded.

The golf ball may have a hardness distribution in which the hardness is gradually increased from the center to the surface of the ball. This is advantageous in that since the deformation of the hit ball is not locally but wholly diffused to the ball, it is possible to lower the spin of the ball, to increase the carrying angle of the ball, and to enhance the resilience.

The golf ball of the present invention can be produced in accordance with a golf rule for games. In particular, to optimize the relationship between each of the specific gravity of the solid core and the specific gravity of the cover and the (S) value, the diameter (D) may be in a range of 42.60 mm or more, preferably, 42.70 mm or more, with the upper limit being in a range of 42.78 mm or less, preferably, 42.75 mm or less, and the weight (W) may be in a range of 45.9 g or less, preferably, 45.6 g or less, with the lower limit being in a range of 45.1 g or more, preferably, 45.2 g or more, more preferably, 45.3 g or more.

As described above, the present invention can provide a golf ball capable of enhancing the durability to increase the carry of the ball with less variations in carry of the ball.

EXAMPLES

The present invention will be more clearly understood by way of, while not limited thereto, the following examples and comparative examples.

Examples 1 to 3 and Comparative Examples 1 to 5

A rubber composition for a solid core was prepared by mixing respective core components with 100 parts by mass of cis-1,4-polybutadiene (BR01 sold by Japan Synthetic Rubber Co., Ltd.) as shown in Table 1, and a solid core was produced from the rubber composition under a condition shown in Table 1.

TABLE 1

| | | Kind of core | | | |
|---|---|---|---|---|---|
| | | A | B | C | D |
| Composition (Parts by mass) | cis-1,4-polybutadiene | 100 | 100 | 100 | 100 |
| | Zinc acryltate | 30 | 23 | 18 | 23 |
| | Barium sulfate | 8 | 11 | 13 | 17 |
| | Zinc oxide | 5.0 | 5.0 | 5.0 | 5.0 |
| | Dicumyl peroxide | 1.4 | 1.4 | 1.4 | 1.4 |
| Vulcanizing condition | Temperature (° C.) | 160 | 160 | 160 | 160 |
| | Time (min) | 16 | 16 | 16 | 16 |
| Specific gravity | | 1.12 | 1.12 | 1.12 | 1.17 |

Next, a cover material mainly containing an ionomer resin shown in Table 2 (Surlyn, sold by Du Pont DE NEMOURS & COMPANY, USA) was prepared, and the following physical properties thereof were examined. The results are shown in Table 2.

Shore D Hardness. JIS-C Hardness

The Shore hardness not on the surface of the ball but on the surface of the resin sheet was measured under JIS-K 6253 by using a duro-meter of Type D under ASTM D224. The JIS-C hardness on the surface of the resin sheet was measured under JIS-K6301.

Specific Gravity

The specific gravity of the sheet-shaped cover material was measured by using a specific gravity meter.

TABLE 2

| | | Kind of cover | | | |
|---|---|---|---|---|---|
| | | A | B | C | D |
| Composition (Parts by mass) | Surlyn 7930 | 100 | 66 | 57.5 | 66.5 |
| | Surlyn 6320 | 0 | 34 | 42.5 | 33.5 |
| | Barium sulfate | 15 | 15 | 15 | 0 |
| | Titanium dioxide | 5.0 | 5.0 | 5.0 | 5.0 |
| | Magnesium stearate | 1 | 1 | 1 | 1 |
| Specific gravity | | 1.10 | 1.10 | 1.10 | 0.98 |
| JIS-C hardness | | 95.3 | 90.7 | 83.5 | 90.65 |
| Shore D hardness | | 64 | 60 | 54 | 60 |

The cover material shown in Table 2 was injection-molded around the solid core produced by using the rubber composition shown in Table 1. Two piece solid golf balls having cores and covers combined with each other as shown in Table 3 and having dimples of the same shape were thus prepared.

The shape and the physical properties of each of the two-piece solid golf balls thus obtained were examined in accordance with the following measurement standards. The results are shown in Table 3

Thickness of Cover

The thickness of the cover was calculated on the basis of a relationship of (outer diameter of ball—outer diameter of core)/2.

Outer Diameter of Ball

The outer diameter of the ball at a portion with no dimple was measured.

Flexural Amount Measured by Applying Load of 98 to 1274 N

The flexural amount (mm), that is, deformed amount (mm) of each of the solid core and ball at the time of applying a load of 98 N (10 kg) to 1274 N (130 kg) thereto was measured.

Physical Properties of Golf Ball

The ball was hit with a swing robot (Miyamae Co. Ltd.), to which a driver (PRO230Titan, sold by Bridgestone Sports Co., Ltd.) was mounted, at a head speed of 40 m/s, and the arrival distances (carry, run, total) of the ball were measured. The initial velocity and spin of the ball immediately after hitting were measured by using a high-speed camera.

Index of Durability of Ball

Each ball was continuously, repeatedly hit with the above-described swing robot (head speed; 45 m/s) until the ball was cracked. The durability of each ball was evaluated by an index which was the number of cracking on the basis of the number of cracking (taken as 100) of the ball in Example 1.

Index of Initial Velocity

Each ball was hit with the above-described swing robot at each of head speeds of 45 m/s (abbreviated by HS45) and 35 m/s (abbreviated as HS35), and the initial velocity of the ball was measured. Such an initial velocity of each ball was evaluated by an index which was the initial velocity on the basis of the initial velocity (taken as 100) of the ball in Example 1.

TABLE 3

| | | Example | | | Comparative example | | | | |
|---|---|---|---|---|---|---|---|---|---|
| | | 1 | 2 | 3 | 1 | 2 | 3 | 4 | 5 |
| Core | | | | | | | | | |
| Kind | | B | B | C | A | C | A | A | D |
| Outer diameter (mm) | | 40.3 | 39.1 | 38.1 | 40.3 | 37.7 | 39.1 | 38.1 | 39.1 |
| Hardness (mm) [load: 98-1274N] | | 4.7 | 4.6 | 5.5 | 3.7 | 5.4 | 3.6 | 3.5 | 4.5 |
| JIS-C hardness | Core center | 56 | 57 | 52 | 66 | 52 | 66 | 66.2 | 56 |
| | Core surface | 71 | 70 | 64 | 79.8 | 62 | 77.6 | 75.6 | 72 |
| Cover | | | | | | | | | |
| Kind | | A | B | B | A | B | C | C | D |
| Thickness (mm) | | 1.2 | 1.8 | 2.3 | 1.2 | 2.5 | 1.8 | 2.3 | 1.8 |
| Shore D hardness | | 64.0 | 60.0 | 60.0 | 64.0 | 60.0 | 54.0 | 54.0 | 60.0 |
| Specific gravity ratio (core/cover) | | 1.00 | 1.00 | 1.00 | 1.00 | 1.00 | 1.00 | 1.00 | 1.17 |
| Golf ball | | | | | | | | | |
| Outer diameter (mm) | | 42.7 | 42.7 | 42.7 | 42.7 | 42.7 | 42.7 | 42.7 | 42.7 |
| Weight (g) | | 45.2 | 45.2 | 45.2 | 45.2 | 45.2 | 45.2 | 45.2 | 45.2 |
| S value | | 1.11 | 1.11 | 1.11 | 1.11 | 1.11 | 1.11 | 1.11 | 1.11 |
| JIS-C hardness difference | Ball surface-core surface | 25.5 | 21.0 | 27.0 | 16.6 | 29.1 | 8.5 | 10.4 | 19.0 |
| | Ball surface-core center | 40.5 | 34.0 | 39.0 | 30.4 | 39.1 | 20.1 | 19.8 | 35.0 |
| Ball surface JIS-C hardness | | 96.5 | 91 | 91 | 96.4 | 91.1 | 86.1 | 86 | 91 |
| Hardness (mm) [load: 98-1274 N] | | 4.0 | 3.8 | 4.3 | 3.2 | 4.1 | 3.5 | 3.5 | 3.8 |
| Cracking durability index | | 100 | 120 | 105 | 105 | 115 | 120 | 125 | 70 |
| Initial velocity index HS35 | | 100 | 100.9 | 101 | 99.1 | 99 | 98.8 | 99 | 100.3 |
| Initial velocity index HS45 | | 100 | 101 | 100 | 100.4 | 99.2 | 99.5 | 99.1 | 101 |
| W#1 (HS45) | Spin (rpm) | 2219 | 2269 | 2280 | 2820 | 2320 | 2435 | 2515 | 2300 |
| | Carry (m) | 218 | 219 | 219 | 219.5 | 215 | 216 | 215.5 | 219 |
| | Run (m) | 16 | 16.5 | 15.5 | 9.0 | 13 | 13.5 | 12 | 11 |
| | Total (m) | 234 | 235.5 | 234.5 | 228.5 | 228 | 229.5 | 227.5 | 230 |

As is apparent from the results shown in Table 3, each of the golf balls in Examples 1 to 3 exhibits high durability, high spin performance, and very high resilience. On the contrary, each of the golf balls in Comparative Examples 1 to 5 exhibits the following disadvantages:

Comparative Example 1

Since the spin of the ball is large and the ballistic path is blown up, the carry is prolonged but the run is shortened, and thereby the total distance is shortened.

Comparative Example 2

The index of the initial velocity is small, and the carry is not prolonged.

Comparative Example 3

The index of the initial velocity is small (particularly, in the case of the head speed of 35 m/s), and further, the ballistic path is dropped, the run is shortened, and the total distance is also shortened.

Comparative Example 4

The index of the initial velocity is small, the ballistic path is dropped, the run is shortened, and the total distance is shortened.

Comparative Example 5

The velocity and angle at the time of the drop of the ball become worse, the run is shortened, and the total distance is shortened.

Experimental Example

The following comparison experiment was made using the materials in Example 2 and Comparative Example 6.

A two-piece solid golf ball was produced by using the same material and the same combination of the core and cover as those in each of Example 2 and Comparative Example 6. In this case, as shown in FIG. 1, the solid core 1 was purposely off-centered to cause a difference in thickness of the cover 2. In the FIGURE, character A designates the maximum thickness of the cover, and B designates the minimum thickness of the cover.

Sample I (Equivalent to Example 2):

$$A-B=0.1 \text{ (mm)}$$

Sample II (Equivalent to Comparative Example 6):

$$A-B=0.5 \text{ (mm)}$$

Each sample ball was subjected to carrying test made by hitting the ball with a hitting robot provided with the driver at a head speed of 45 m/s. This test was repeated for 30 pieces of the samples I and 30 pieces of the sample II.

For the sample balls I (using the same material as that in Example 2), 28 pieces of the balls were landed in a circle having a diameter of 5 m prepared at a target point of 220 m, and 27 pieces of the balls were stopped in a circle having a diameter of 10 m prepared at a target point of 235 m.

For the sample balls II (using the same material as that in Comparative Example 6), only 21 pieces of the balls were landed in the circle having the diameter of 5 m prepared at the target point of 220 m, and only 17 pieces of the balls were stopped in the circle having a diameter of 10 m prepared at the target point of 235 m.

While the preferred embodiments of the present invention have been described using specific terms, such description is for illustrative purpose only, and it is to be understood that changes and variations may be made without departing from the spirit or scope of the following claims.

What is claimed is:

1. A solid golf ball comprising a solid core and a cover of at least one layer;

wherein each of a specific gravity of said solid core and a specific gravity of said cover is nearly equal to a value (S) of a relation expression given by:

$$S=W/[(\pi/6)\times D^3]$$

where W is a weight of said golf ball in a range of 45.1 to 45.9 g and D (cm) is a diameter of said golf ball, a surface hardness of said solid core is higher than a center hardness of said solid core by 8 to 20 in JIS-C hardness, a surface hardness of said golf ball is higher than a center hardness of said solid core by 20 to 45 in JIS-C hardness and a surface hardness of said golf ball is higher than a surface hardness of said solid core by 10 to 30 in JIS-C hardness, and a flexural amount of said golf ball, measured by applying a load of 98 to 1274N thereto, is in a range of 3.5 to 6.0 mm.

2. The solid golf ball according to claim 1, wherein a diameter (D) of said golf ball is in a range of 42.60 to 42.78 mm.

3. The solid golf ball according to claim 1, wherein a ratio of a specific gravity of said solid core to a specific gravity of said cover (specific gravity of solid core/specific gravity of cover) is in a range of 0.9 10 to 1.095.

4. A golf ball comprising a solid core and a cover of at least one layer;

wherein each of a specific gravity of said solid core and a specific gravity of said cover is nearly equal to a value (S) of a relation expression given by:

$$S=W/[(\pi/6)\times D^3];$$

where W is a weight of said golf ball in a range of 45.1 to 45.9 g and D (cm) is a diameter of said golf ball;

a surface hardness of said solid core is higher than a center hardness of said solid core by 8 to 20 in JIS-C hardness;

a surface hardness of said golf ball is higher than a center hardness of said solid core by 20 to 45 in JLS-C hardness and a surface hardness of said golf ball is higher than a surface hardness of said solid core by 10 to 30 in JIS-C hardness;

a flexural amount of said golf ball, measured by applying a load of 98 to 1274N thereto, is in a range of 3.5 to 6.0 mm; and wherein said golf ball is a two-piece solid golf ball including a solid core and a cover of one layer.

* * * * *